US007363752B2

(12) United States Patent
Bingel, III et al.

(10) Patent No.: US 7,363,752 B2
(45) Date of Patent: Apr. 29, 2008

(54) POLE REINFORCEMENT TRUSS

(75) Inventors: Nelson G. Bingel, III, Orchard Park, NY (US); Lawrence J. Geitner, Hamburg, NY (US); Brian E. Reed, Eden, NY (US)

(73) Assignee: Osmose, Inc., Buffalo, NY (US)

( * ) Notice: Subject to any disclaimer, the term of this patent is extended or adjusted under 35 U.S.C. 154(b) by 490 days.

(21) Appl. No.: 10/811,333

(22) Filed: Mar. 26, 2004

(65) Prior Publication Data

US 2005/0210821 A1 Sep. 29, 2005

(51) Int. Cl.
*E04C 3/30* (2006.01)

(52) U.S. Cl. ..... 52/737.5; 52/736.1; 52/730.6

(58) Field of Classification Search ..... 52/737.3, 52/737.4, 737.5, 736.3, 736.4, 733.2, 731.7, 52/736.1, 760.6, 170; 47/32.4, 32.5, 32.6, 47/29.7, 42, 73

See application file for complete search history.

(56) References Cited

U.S. PATENT DOCUMENTS

| | | | | |
|---|---|---|---|---|
| 574,641 | A | 1/1897 | Streator | |
| 1,609,541 | A | 12/1926 | Gooding | |
| 1,960,961 | A | 5/1934 | Thomas | |
| 2,508,032 | A * | 5/1950 | Kennedy | 52/731.7 |
| 3,309,824 | A | 3/1967 | Barrett | |
| 3,350,822 | A | 11/1967 | Nachazel | |
| 3,362,124 | A | 1/1968 | Cravens et al. | |
| 3,387,418 | A | 6/1968 | Tyrer | |
| 3,950,912 | A | 4/1976 | Lundberg et al. | |
| 4,258,523 | A | 3/1981 | Waugh | |
| 4,756,130 | A | 7/1988 | Burtelson | |
| 4,881,355 | A | 11/1989 | Bosl et al. | |
| 4,987,718 | A | 1/1991 | Knight | |
| 5,383,749 | A | 1/1995 | Reisdorff et al. | |
| 5,464,302 | A | 11/1995 | Menchetti | |
| 5,575,966 | A * | 11/1996 | Baatz | 264/177.1 |
| 5,622,356 | A | 4/1997 | Duggan | |
| 6,079,165 | A | 6/2000 | Bingel, III et al. | |
| 6,533,249 | B2 * | 3/2003 | Ochoa | 256/13.1 |
| 6,807,781 | B2 * | 10/2004 | Trout | 52/281 |
| 2003/0085394 | A1 * | 5/2003 | Ochoa | 256/13.1 |

OTHER PUBLICATIONS

Genics brochure entitled "MultiRib™ Reinstatement System"; at least as early as Mar. 25, 2004.

Osmose wood preserving, Inc., Buffalo, NY: brochure entitled "Osmo-C-Truss," at least as early as May 20, 1998.

* cited by examiner

*Primary Examiner*—Richard E. Chilcot, Jr.
*Assistant Examiner*—Jessica Laux
(74) *Attorney, Agent, or Firm*—Hodgson Russ LLP

(57) ABSTRACT

A pole reinforcement truss has an open cross-sectional configuration characterized by opposite side flanges that diverge with respect to one another as they extend from respective opposite side edges of the truss body. In a preferred cross-sectional configuration, five curved bends of equal obtuse angle and radius of curvature are used to define the side flanges, a pair of bridge portions, and a pair of apex portions in symmetrical arrangement. The truss maintains its geometry in an improved manner after the onset of yielding, thereby increasing ultimate strength of the pole-truss assembly.

3 Claims, 4 Drawing Sheets

POLE REINFORCEMENT TRUSS

FIELD OF THE INVENTION

The invention relates to the field of trusses for reinforcing poles, especially wooden utility poles, telephone poles, and the like, to increase their useful lifetime and allow them to withstand environmental forces.

BACKGROUND OF THE INVENTION

Utility lines, such as those carrying electrical power, cable television signals or telephone signals, have traditionally been supported above ground using poles, and especially wooden poles. As used herein, the term "pole" includes various forms and definitions of elongated support members, e.g., posts and pilings, whether or not constructed of wood. Such poles must be capable of withstanding not only the columnar load applied by the weight of the objects supported thereon but also the transverse or horizontal load imposed by transverse winds or unbalanced wire tensions from angled or dead end wires that cause the upper end of the pole to deflect relative to the buried bottom end of the pole.

After some years in service, wooden utility poles tend to experience decay and rotting just below and/or slightly above ground level. While the decayed region is normally relatively small and the penetration of the decay may be limited, the pole is nonetheless structurally weakened and may not be sufficiently strong to withstand wind and other environmental factors. Under these conditions, wind forces can result in a pole breaking and toppling, sometimes without warning.

Therefore, it is necessary to periodically replace older wooden poles. The demand for replacement poles, in combination with the demand for new poles, has become increasingly difficult to meet. This demand presents environmental concerns related to deforestation and the toxic effects of preservative chemicals used to treat the poles. In addition, replacement of existing poles is expensive and may require interruption of service to users of the utility. To overcome these and other problems associated with pole replacement, various methods and apparatus for reinforcing in-service poles have been developed to extend their useful life.

One technique for reinforcing utility poles is that of coupling an elongated truss to the pole, in effect splinting or bridging across the weakened area of the pole. Such trusses are customarily adapted to extend at least partway along the pole parallel to its longitudinal axis to provide support against transverse wind forces and other loading conditions. The steel truss has been used to strengthen wooden utility poles for more than forty years.

One such pole reinforcing apparatus is the OSMOSE® Osmo-C-Truss™ system. This truss helps to restore the groundline strength of utility poles at a fraction of the cost of pole replacement. The Osmo-C-Truss™ system comprises a C-shaped galvanized steel reinforcing truss which is secured to a pole by a plurality of galvanized steel bands fastened around the perimeter of the truss/pole assembly. The Osmo-C-Truss™ system can extend the life of a pole for many years and is installed without interrupting service to utility customers.

In spite of the many advantages of the Osmo-C-Truss™ system, some performance issues are inherent in the use of a "C" or channel shaped reinforcing apparatus. One significant performance issue is related to the ability of a "C" or channel shaped design to withstand bending loads from a pole without twisting or rotating about the pole. One solution in the prior art is to increase or "beef up" the capacity of the apparatus by increasing its dimensions or the yield strength of the material of construction. However, these approaches fail to consider the underlying mechanical principles that govern the performance of such devices under load. Because the shear centers and the elastic axes of the reinforcing apparatus reside well outside the locus of the applied transverse load, there results significant torsional forces acting upon the reinforcing apparatus in addition to the expected bending forces. Specifically, "C" or channel shaped designs do not account for the relationship between the location of the shear center of the truss and the location of the transverse applied load. The further the applied load is from the shear center and elastic axis, the greater the torsional forces that act upon the truss in combination with the bending forces. Torsional forces may cause the truss to shift its position about the circumference of the pole, i.e., rotate about the pole, to a disadvantageous position wherein the truss is no longer loaded in the direction of maximum strength. Further, the reinforcing apparatus itself may twist and experience shape distortion when subjected to torsional forces, causing a reduction in performance; possibly less than the theoretical strength of the material of construction would afford.

Without a corresponding decrease in torsional rotation of the apparatus about the pole, or a reduction in the torsional forces themselves, the increased theoretical resistance to bending forces supplied by a truss having increased dimensions or higher yield material may be of little practical value. In fact, the use of higher strength materials to increase truss capacity is accompanied by a generally proportional increase in the truss rotations and deflections that occur when the truss is loaded beyond the capacity of a similarly-dimensioned truss formed of lower strength material. The reinforced truss will undergo unacceptable rotation or twisting deformation, causing premature failure before its theoretical bending capacity, as determined using the undistorted shape, is reached. Further, while measures such as adding material of higher yield strength may increase theoretical bending support, they represent significant added costs, in many cases without yielding proportionate benefits or expected results.

In an effort to address the problems mentioned above, several improved truss embodiments are described in U.S. Pat. No. 6,079,165 sharing common inventors herewith. The embodiments involve various cross-sectional configurations intended to bring the elastic axis and shear center of the open truss section closer to the pole and to the point where load is transferred from the pole to the truss, thereby reducing torsional loading on the truss.

While the truss configurations described in U.S. Pat. No. 6,079,165 offer improved performance relative to prior trusses, there is still a tendency for all prior art trusses to rotate about the pole to a position where the load is no longer acting along an intended direction relative to the truss section, and is instead acting along a weak axis of the truss section. It has been observed that this problem actually gets worse as higher yield strength steel is used, thereby defeating the purpose of using higher yield steel. At the onset of yielding, there is a tendency for buckling to occur in pole-engaging side flanges of prior art trusses. Consequently, the geometry of the truss cross-section changes, thereby decreasing the effectiveness of the truss and leading to ultimate failure rather rapidly after the onset of first yielding. Generally speaking, prior art trusses have been designed for elastic capacity, and have not been designed to resist buckling.

Accordingly, there is a need for a pole reinforcement truss that better maintains its cross-sectional geometry after the onset of yielding.

SUMMARY OF THE INVENTION

Therefore, it is an object of the present invention to provide a pole reinforcement truss that resists buckling to exhibit greater strength beyond yielding trusses of the prior art.

It is another object of the present invention to provide a pole reinforcement truss that exhibits improved strength when loaded in an "off-axis" direction offset from a strong axis of the truss section.

It is another object of the present invention to provide a pole reinforcement truss that resists rotation around the pole when banded to the pole.

It is a further object of the present invention to provide a pole reinforcement truss having the above-mentioned qualities that is simple and inexpensive to manufacture.

These and other objects are achieved by a pole reinforcement truss of the present invention that generally comprises an elongated body having a pair of opposite ends connected by a pair of longitudinal edges, wherein the body has an open cross-sectional configuration characterized by a pair of side flanges each extending from a respective one of the longitudinal edges in a direction diverging from the other side flange, and an intermediate section connecting the pair of side flanges.

In a preferred embodiment, the intermediate section includes a pair of bridge portions associated one with each of the pair of side flanges, and a pair of apex portions associated one with each of the pair of bridge portions. Each bridge portion extends in a direction forming an included obtuse angle with the direction of the associated flange, and each apex portion extends in a direction forming an included obtuse angle with the direction of the associated bridge portion. The pair of apex portions converge toward one another to form an excluded obtuse angle. In an embodiment exhibiting desired results, the excluded angle between the apex portions, the included angle between each bridge portion and its associated apex portion, and the included angle between each side flange and its associate bridge portion are equal, preferably about 100 degrees, and are defined by way of curved bends.

The invention also extends to a method of manufacturing a pole reinforcement truss from a length of plate of sheet material by forming a first curved bend along a longitudinal first axis to give the material a generally V-shaped cross-sectional configuration; forming a pair of second curved bends of opposite bearing to the first curved bend along a pair of longitudinal second axes arranged on opposite sides of the first axis, the pair of second curved bends defining a pair of side flanges each limited by an associated one of the pair of second curved bends and an associated side edges; and forming a pair of third curved bends of opposite bearing to the first curved bend along a pair of longitudinal third axes arranged on opposite sides of the first axis between the pair of second axes. The first curved bend, the pair of second curved bends, and the pair of third curved bends are formed so that the pair of side flanges converge toward one another as they extend from the pair of second curved bends toward the pair of edges.

BRIEF DESCRIPTION OF THE DRAWINGS

The nature and mode of operation of the present invention will now be more fully described in the following detailed description of the invention taken with the accompanying drawing figures, in which.

DETAILED DESCRIPTION OF THE INVENTION

Figure 1:
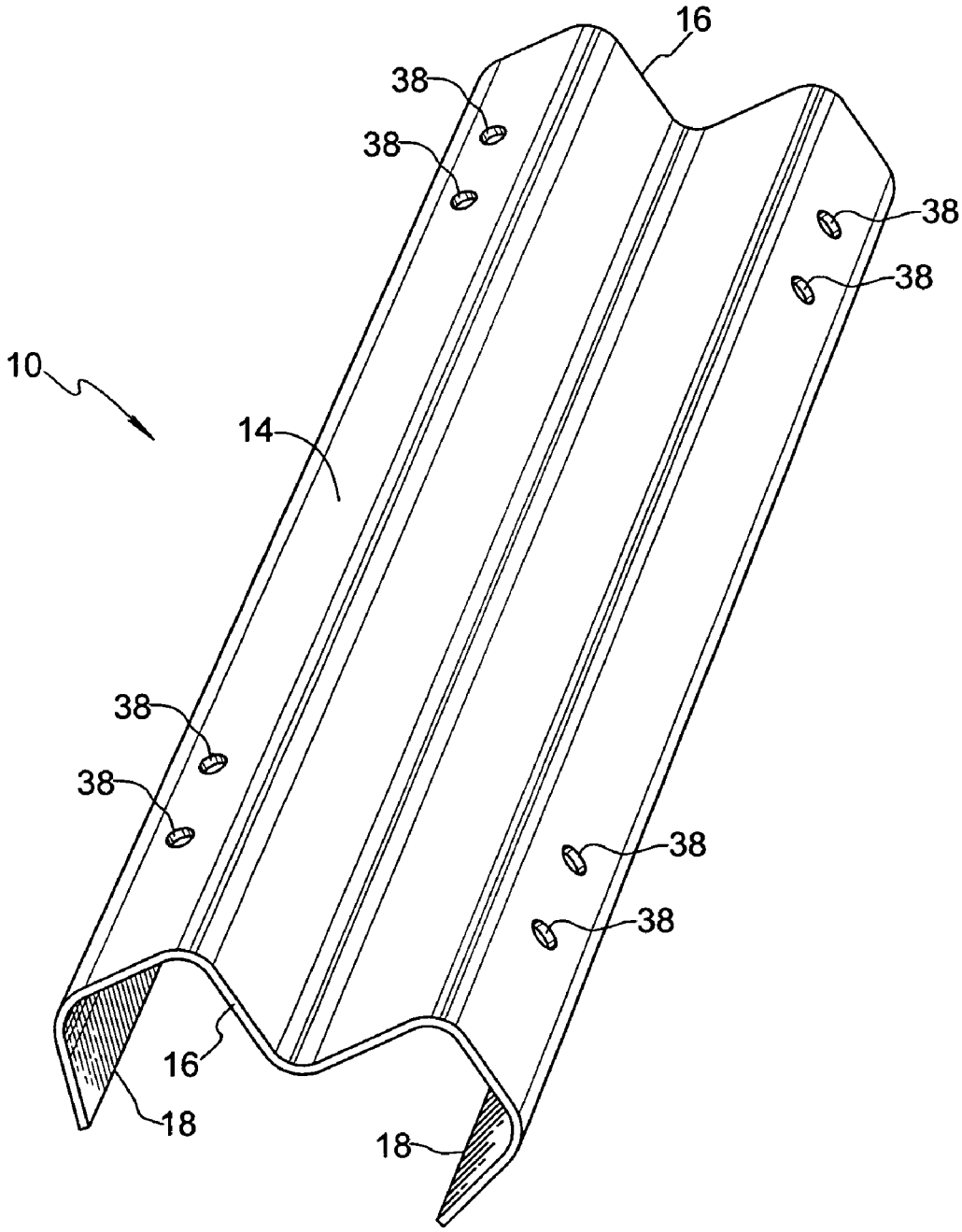
FIG. 1 is a perspective view showing a truss formed in accordance with a preferred embodiment of the present invention.
Figure 2:
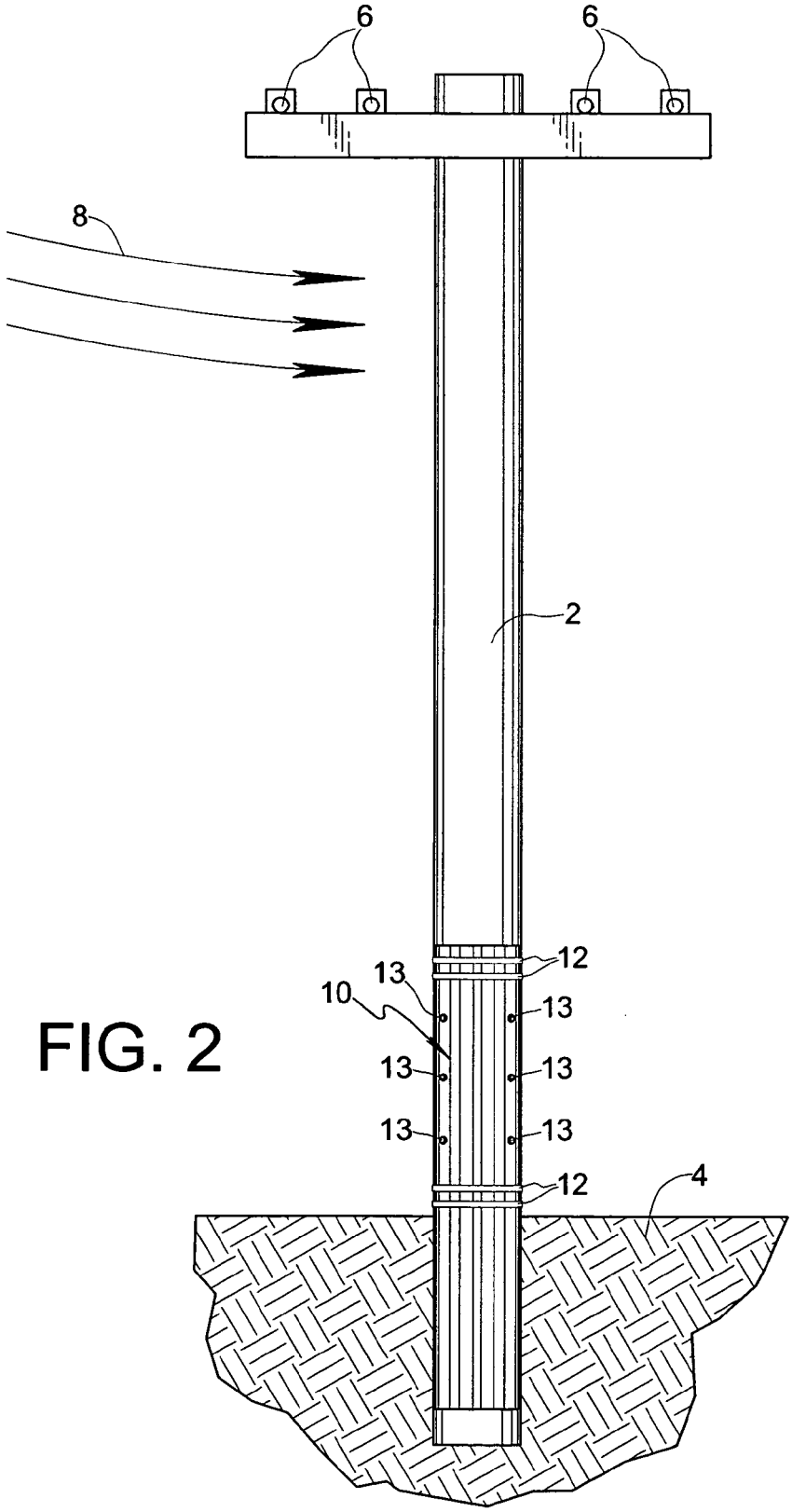
FIG. 2 is an elevational view showing the installation of the truss on a utility pole.

FIG. 1 shows a truss 10 formed in accordance with an embodiment of the present invention. Truss 10 generally comprises an elongated body 14 having a pair of opposite ends 16 connected by a pair of longitudinal edges 18. As illustrated in FIG. 2, truss 10 is useful for reinforcing a utility pole 2 sunk at its lower end into ground 4 and configured to support utility wires 6. The truss 10 reinforces pole 2 against transverse winds 8 or other environmental forces, including unbalanced wire tensions, and is attached to a lower portion of the pole using circumferential bands 12 and/or bolts 13. Although truss 10 of the present invention is shown and described in the context of a utility pole, it is suitable to reinforce other types of poles as well.

Figure 3:
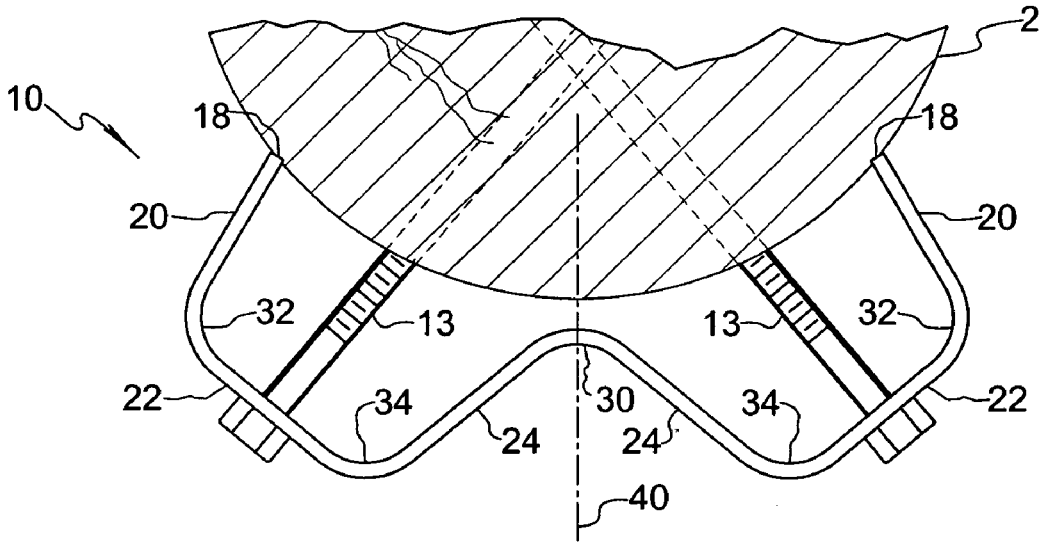
FIG. 3 is a view showing the cross-sectional configuration of the truss as the truss is installed in a first orientation relative to a pole.

Body 14 of truss 10 has an open cross-sectional configuration, shown in FIG. 3, which can be constant over the length of the truss, or which can change in scale over the length of the truss to provide a tapered truss. The cross-sectional configuration is characterized by a pair of side flanges 20 each extending from a respective one of the longitudinal edges 18 in a direction diverging from the other side flange 20, and an intermediate section connecting the pair of side flanges 20 and comprising a central first curved bend 30, a pair of apex portions 24 joined by the first curved bend 30, a pair of bridge portions 22 respectively joined to the pair of side flanges 20 by a pair of second curved bends 32, and a pair of third curved bends 34 each joining a respective bridge portion 22 to an associated apex portion 24. The cross-sectional configuration has an axis of symmetry 40 midway between the pair of edges 18 through a center of curvature of first curved bend 30.

Figure 6:
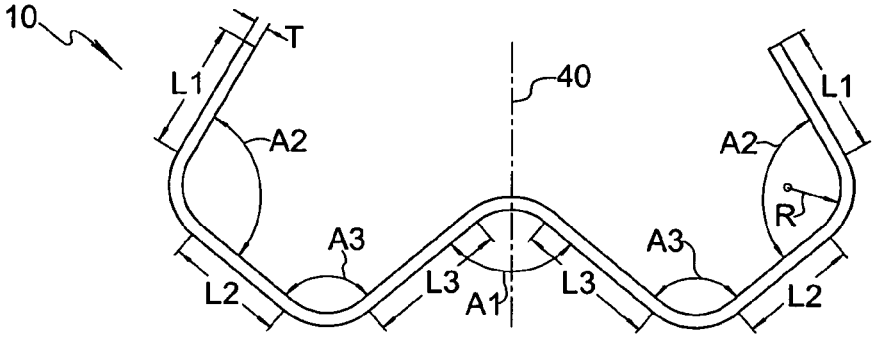
FIG. 6 is a cross sectional view of the truss with dimensional reference characters for describing a truss of an advantageous scale.

Reference is made to FIG. 6 to further describe the cross-sectional configuration of truss body 14. Each bridge portion 22 extends in a direction forming an obtuse included angle A2 with the direction of the associated side flange 20. Each apex portion 24 extends in a direction forming an obtuse included angle A3 with the direction of the associated bridge portion 22, wherein the pair of apex portions 24 converge toward one another to form an excluded angle A1. As used herein, "included angle" refers to an angle measured on the inside of the truss section, and "excluded angle" refers to an angle measured on the outside of the truss section. From a general standpoint, the angles A1, A2, and A3 are chosen to satisfy the following relation:

$$180-A2-A3+\tfrac{1}{2}*A1>0$$

where A1, A2, and A3 are expressed in degrees. By satisfying this relationship, the side flanges 20 are caused to diverge from one another as they extend from their respective edges 18.

By way of non-limiting example, below is a table showing presently preferred dimensions of the cross-sectional configuration for a truss designed to be used with poles ranging from 27.5 inches (69.85 centimeters) to 36.5 inches (92.71 centimeters) in circumference.

| Dimension | Inches | Centimeters | Degrees |
|---|---|---|---|
| A1 | | | 100 |
| A2 | | | 100 |
| A3 | | | 100 |
| L1 | 1.8485 | 4.6952 | |
| L2 | 1.6969 | 4.3101 | |
| L3 | 2.0094 | 5.1039 | |
| R (all bends) | 0.75 | 1.905 | |
| T | 0.1875 | 0.4763 | |

Figure 5A:
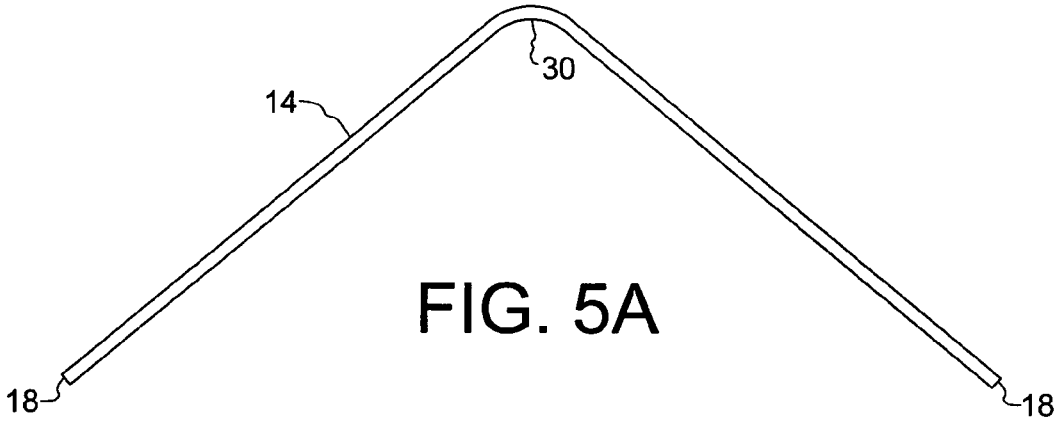
FIGS. 5A-5C illustrate steps for manufacturing the truss from a piece of material.
Figure 5B:
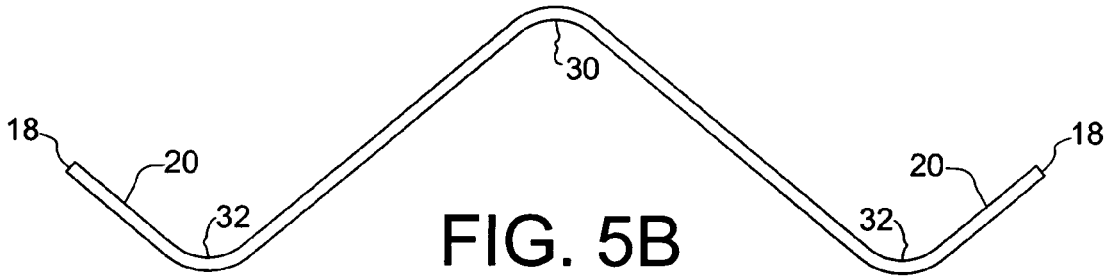
Figure 5C:
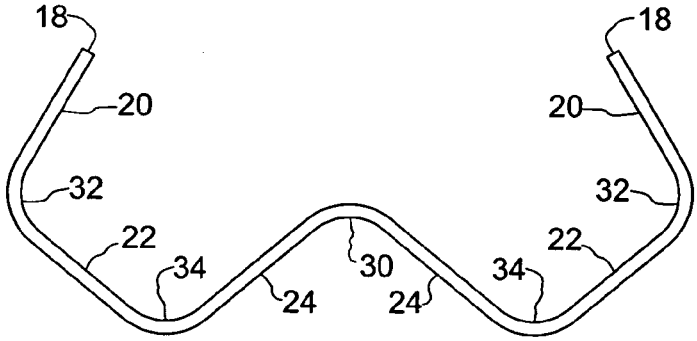

FIGS. 5A through 5C illustrate a preferred method of fabricating truss 10 in accordance with the present invention. To begin, a flat piece of metal sheet or plate stock material of appropriate width is cut to length; a preferred length suitable for most applications is ten feet (3.048 meters), however another length may be chosen depending upon the application. In the example represented by the table above, a length of 3/16-inch thick steel plate seventeen inches wide was used. The material is preferably alloy steel having a yield strength on the order of 100,000 psi (689,476 kPa). The workpiece, which may be tapered or rectangular, is then formed using a press brake. The first curved bend 30 is formed along a central longitudinal axis of the workpiece to give the sheet material a generally V-shaped cross-sectional configuration as shown in FIG. 5A. Next, the pair of second curved bends 32 are formed along a pair of longitudinal second axes located one on each opposite side of the central first axis at equal distances therefrom, thereby defining the pair of side flanges 20 each limited by an associated one of the pair of second curved bends 32 and an associated one of the pair of edges 18. As can be seen in FIG. 5B, the second curved bends 32 are of opposite bearing to the first curved bend 30. Finally, the pair of third curved bends 34, also of opposite bearing to first curved bend 30, are formed along a pair of longitudinal third axes located one on each opposite side of the central first axis at equal distances from the central axis, wherein the pair of third axes are between the pair of second axes. The result of this step can be seen in FIG. 5C. If bolts 13 will be used to secure truss 10 to pole 2, then bolt holes 38 (shown in FIG. 1) can be drilled before all bending steps, between bending steps, or after all bending steps.

Returning now to FIG. 3, a first installation orientation of truss 10 relative to pole 2 is shown, wherein an open mouth of the truss section faces the pole such that edges 18 engage the pole. Bolts 13 are preferably arranged to extend through holes 38 in each bridge portion 22 for securing truss 10 to pole 2, and it is also contemplated to arrange bolts to extend through centrally located bolt holes through curved bend 30 in addition to, or in place of, bolts through bridge portions 22. Bolts 13 are preferably through-bolts extending through pole 2, however shorter lag bolts may also be used.

Figure 4:
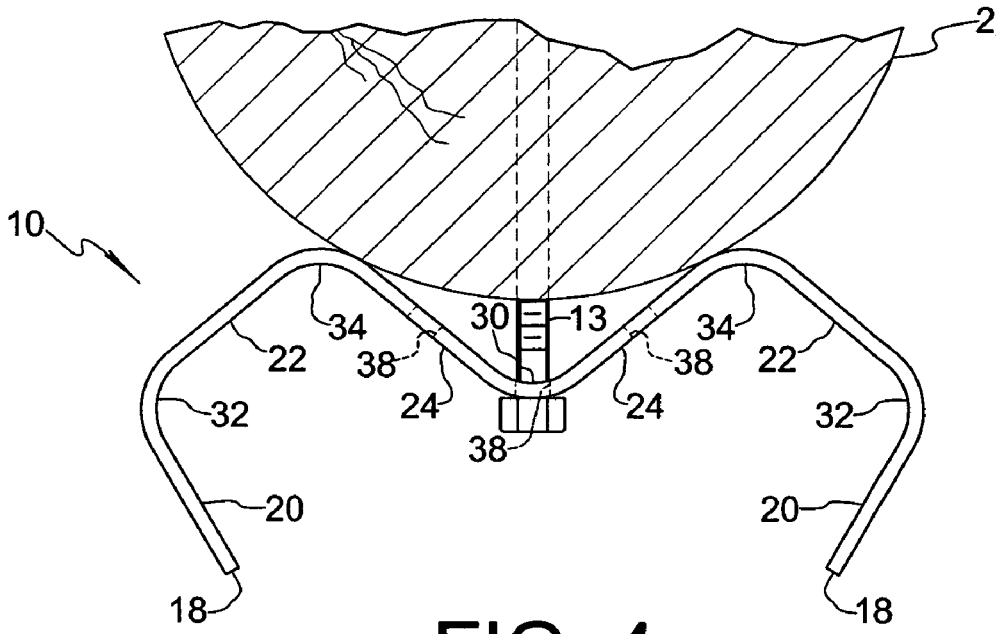
FIG. 4 is a view similar to that of FIG. 3, however showing the truss installed in a second orientation relative to the pole.

As shown in FIG. 4, truss 10 can be installed in an opposite orientation wherein the mouth of the truss section faces away from pole 2. In this orientation, bolts 13 are arranged to extend through centrally located bolt holes through curved bend 30, and could also be arranged to extend through holes 38 in apex portions 24. The fact that truss 10 is reversible in this manner makes installation possible in cases where the orientation of FIG. 3 cannot be used due to interfering hardware already on the pole, an important advantage over non-reversible trusses.

FIG. 2 shows truss 10 installed adjacent the bottom buried end of pole 2 such that it bridges from the buried portion of the pole to the exposed portion of the pole, thereby providing reinforcement where localized rotting and weakening of the pole is most likely to occur or to have occurred. Of course, installation at other segments of the pole may be advisable, particularly in locations where the pole has sustained localized damage that might weaken the pole.

As will be appreciated, the cross-sectional configuration of truss 10 has a shear center that is located close to pole 2 and thus to the location at which force is transmitted to the truss, so as to minimize torsional loading on the truss. Moreover, by angling side flanges 20 inward toward the pole as shown in FIG. 3, the flanges are shorter and are optimized between inward and outward buckling to help the truss maintain its original cross-sectional geometry after the onset of yielding. Because the truss resists buckling and better maintains its original geometry, it has improved plastic capacity (strength beyond yielding) relative to trusses of the prior art. The truss of the present invention is designed to increase the ultimate strength of the pole-truss assembly, as distinguished from the yield strength, to provide greater benefit to utility companies. The truss also exhibits better "off-axis" strength relative to prior art trusses in situations where the truss must be installed at a less than ideal position on the pole, for example if a riser or communications box is in the way.

Another benefit realized by truss 10 when it is installed as shown in FIG. 3 is that the side flanges 20 provide a better grip on the pole to help prevent the truss from rotating about the pole if the truss is mounted to the pole solely by bands 12, which are less expensive to use than bolts 13.

It will also be appreciated that truss 10 of the present invention is economical to manufacture. In the embodiment represented by the table appearing above, all five curved bends (curved bend A1, both curved bends A2, and both curved bends A3) have the same radius of curvature and define the same angle between joined straight portions of the cross-section. Consequently, press brake setup is extremely simple. It is preferred to keep the angles A1, A2, and A3 constant and provide different size trusses by changing lengths L1, L2, and L3, which can be accomplished by choosing stock of a different width and/or altering the locations of the second and third curved bends 32 and 34. It is also noted that the present invention allows five truss sizes of the prior art to be replaced by just two truss sizes.

REFERENCE NUMERALS

2 Pole
4 Ground
6 Utility lines
8 Wind
10 Truss
12 Bands

13 Bolts
14 Truss body
16 Truss ends
18 Longitudinal edges
20 Side flanges
22 Bridge portions
24 Apex portions
30 First curved bend
32 Second curved bends
34 Third curved bends
38 Bolt holes
40 Axis of symmetry
A1 Excluded angle
A2 Second included angle
A3 First included angle
L1 Cross-sectional length of side flange
L2 Cross-sectional length of bridge portion
L3 Cross-sectional length of apex portion
R Radius of curved bend
T Thickness

What is claimed is:

1. A combination comprising:

a utility pole having a generally vertical longitudinal axis; and a truss attached to the utility pole for reinforcing the utility pole, wherein the truss comprises:

an elongated body having a pair of opposite ends connected by a pair of longitudinal edges, wherein the longitudinal edges extend substantially parallel to the longitudinal axis of the utility pole;

the body having an open cross-sectional configuration characterized by a pair of side flanges each extending from a respective one of the longitudinal edges in a direction diverging from the other side flange, and an intermediate section connecting the pair of side flanges, wherein the intermediate section of the cross-sectional configuration includes:

a pair of bridge portions associated one with each of the pair of side flanges, each bridge portion extending in a direction forming an obtuse angle with the direction of the associated flange; and a pair of apex portions associated one with each of the pair of bridge portions, each apex portion extending in a direction forming an obtuse angle with the direction of the associated bridge portion, wherein the pair of apex portions converge toward one another and fastener holes are provided through each of the pair of apex portions.

2. A combination comprising:

a utility pole having a generally vertical longitudinal axis; and a truss attached to the utility pole for reinforcing the utility pole, wherein the truss comprises:

an elongated body having a pair of opposite ends connected by a pair of longitudinal edges, wherein the longitudinal edges extend substantially parallel to the longitudinal axis of the utility pole;

the body having an open cross-sectional configuration characterized by:

a pair of straight apex portions forming an excluded angle A1 with one another;

a pair of straight bridge portions each forming a first included angle A3 with an associated one of the pair of apex portions;

a pair of straight side flanges each forming a second included angle A2 with an associated one of the pair of bridge portions;

wherein the angles A1, A2, and A3 are chosen to satisfy the following relationship:

$$180-A2-A3+\tfrac{1}{2}*A1>0$$

in which angles A1, A2, and A3 are expressed in degrees, and wherein the excluded angle A1, the first included angle A3, and the second included angle A2 are equal to one another.

3. The truss according to claim 2, wherein the excluded angle A1, the first included angle A3, and the second included angle A2 are all equal to 100°.

* * * * *